US007976113B2

(12) United States Patent
Gwak

(10) Patent No.: US 7,976,113 B2
(45) Date of Patent: Jul. 12, 2011

(54) HOME BAR FOR REFRIGERATOR

(75) Inventor: Young Hoon Gwak, Changwon-si (KR)

(73) Assignee: LG Electronics Inc., Seoul (KR)

( * ) Notice: Subject to any disclaimer, the term of this patent is extended or adjusted under 35 U.S.C. 154(b) by 436 days.

(21) Appl. No.: 12/142,620

(22) Filed: Jun. 19, 2008

(65) Prior Publication Data

US 2009/0009043 A1 Jan. 8, 2009

(30) Foreign Application Priority Data

Jun. 20, 2007 (KR) ..... 10-2007-0060332

(51) Int. Cl.
*A47B 96/00* (2006.01)

(52) U.S. Cl. ..... 312/405.1; 312/292

(58) Field of Classification Search ..... 292/137, 292/163, 175, 145, 150, 302, DIG. 71, DIG. 61; 49/379; 312/405, 405.1, 321.5, 327, 328, 312/215, 222, 292
See application file for complete search history.

(56) References Cited

U.S. PATENT DOCUMENTS

| | | | | | |
|---|---|---|---|---|---|
| 2,176,043 | A * | 10/1939 | Anderson | 292/1 |
| 2,479,597 | A * | 8/1949 | Anton | 16/86 A |
| 2,628,432 | A * | 2/1953 | Morrison | 34/68 |
| 2,656,688 | A * | 10/1953 | Hinkel | 62/441 |
| 3,603,657 | A * | 9/1971 | Hassay | 312/404 |
| 4,183,565 | A * | 1/1980 | Allemann | 292/163 |
| 7,059,693 | B2 * | 6/2006 | Park | 312/405.1 |
| 7,254,958 | B2 * | 8/2007 | Kim et al. | 62/265 |
| 2005/0156433 | A1 * | 7/2005 | Nemoto et al. | 292/163 |

FOREIGN PATENT DOCUMENTS

| | | | |
|---|---|---|---|
| KR | 19990031097 | * | 7/1999 |
| WO | 2009093781 | * | 7/2009 |

OTHER PUBLICATIONS

South Korean abs and Fig for publication 2005058151 Jun. 2005.*
South Korean abs and Fig for publication 2005099573 Oct. 2005.*

* cited by examiner

*Primary Examiner* — Janet M Wilkens
(74) *Attorney, Agent, or Firm* — Birch, Stewart, Kolasch & Birch, LLP

(57) ABSTRACT

Provided is a home bar for a refrigerator that has an improved structure for easy door opening and closing. The home bar includes a home bar frame, a home bar door, a fixing unit, and an elastic member. The home bar frame includes an opening. The home bar door is configured to close the opening. The fixing unit is disposed on the home bar frame and configured to latch the home bar door. The elastic member is disposed at a side of the fixing unit and configured to apply an elastic force for opening the home bar door. Although the home bar does not have an expensive latch structure, the home bar door can be easily opened, closed, and latched. The opening is large such that foods can be easily accessed through the opening. An additional insulating layer can be provided in the home bar door for improving insulating efficiency.

15 Claims, 7 Drawing Sheets

HOME BAR FOR REFRIGERATOR

CROSS-REFERENCE TO RELATED APPLICATIONS

The present application claims priority under 35 U.S.C. 119 and 35 U.S.C. 365 to Korean Patent Application No. 10-2007-0060332 filed on Jun. 20, 2007, which is hereby incorporated by reference in its entirety.

BACKGROUND

The present disclosure relates to a refrigerator home bar, and more particularly, to a refrigerator home bar including a home bar door that can be easily opened and closed.

In the related art, a refrigerator includes a plurality of compartments for storing foods at low temperatures close to or below zero degrees Celsius. Predetermined sides of the storing compartments are opened for allowing access to the foods stored the storing compartment.

Some of recent refrigerators include a home bar installed in a door for preventing unnecessary leakage of cold air caused by frequent opening and closing of the door. Drinks or foods can be accessed through the home bar without having to open the refrigerator door.

The home bar may include a home bar frame and a home bar door. The home bar frame includes an opening for providing access to foods, and the home bar door is used to selectively close and open the opening.

In general, the home bar door is rotatably installed at a side of the opening.

When the home bar door is closed, a latch member fixes the home bar door to the home bar frame. The home bar frame includes a latch assembly corresponding to the latch member.

When the home bar door is closed, the latch member is positioned corresponding to the latch assembly.

When the home bar door is closed, the latch member is inserted and held in the latch assembly so that the home bar door can be stably kept at the closed position.

However, the latch member and the latch assembly are expensive.

Furthermore, the mechanism for latching the home bar door with the latch member and the latch assembly is complicated. Therefore, when the latch member or the latch assembly is out of order, it is difficult to repair the latch member or the latch assembly, and replacement costs are high.

In addition, since the home bar door has an additional space for accommodating the latch member, the insulating ability of the home bar door reduces.

Moreover, since the latch assembly is disposed on the home bar frame, the opening of the home bar frame reduces in size, and thus it may be difficult to provide easy access to foods.

SUMMARY

Embodiments provide a home bar for a refrigerator that includes a home bar door configured to be easily opened and closed.

Embodiments also provide a home bar for a refrigerator that can be economically manufactured and used owing to a simple home bar door opening/closing structure.

Embodiments also provide a home bar for a refrigerator that does not require a complicated latch structure and include a wide insulating layer for preventing leakage of cold air.

Embodiments also provide a home bar for a refrigerator that includes a large opening for providing easy access to foods.

In one embodiment, a home bar for a refrigerator includes a home bar frame comprising an opening; a home bar door configured to close the opening; a fixing unit disposed on the home bar frame and configured to latch the home bar door; and an elastic member disposed at a side of the fixing unit and configured to apply an elastic force in a predetermined direction for opening the home bar door.

In another embodiment, A home bar for a refrigerator includes a home bar frame comprising an opening; a home bar door configured to selectively open and close the opening and comprising a trapping portion; a latch member disposed on the home bar frame and configured to be selectively trapped in the trapping portion; and a pressing member configured to apply a pushing force to the latch member for opening the home bar door.

In another embodiment, a home bar for a refrigerator includes a home bar frame comprising an opening; a home bar door configured to selectively open and close the opening and comprising a trapping portion; a latch member disposed on the home bar frame and configured to be selectively trapped in the trapping portion; a pressing member configured to apply a pushing force to the latch member for opening the home bar door; and an opening guide unit disposed close to the home bar door and configured to apply a force in a predetermined direction for opening the home bar door.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings. The present disclosure may, however, be embodied in many different forms and should not be construed as being limited to the embodiments set forth herein.

Figure 1:
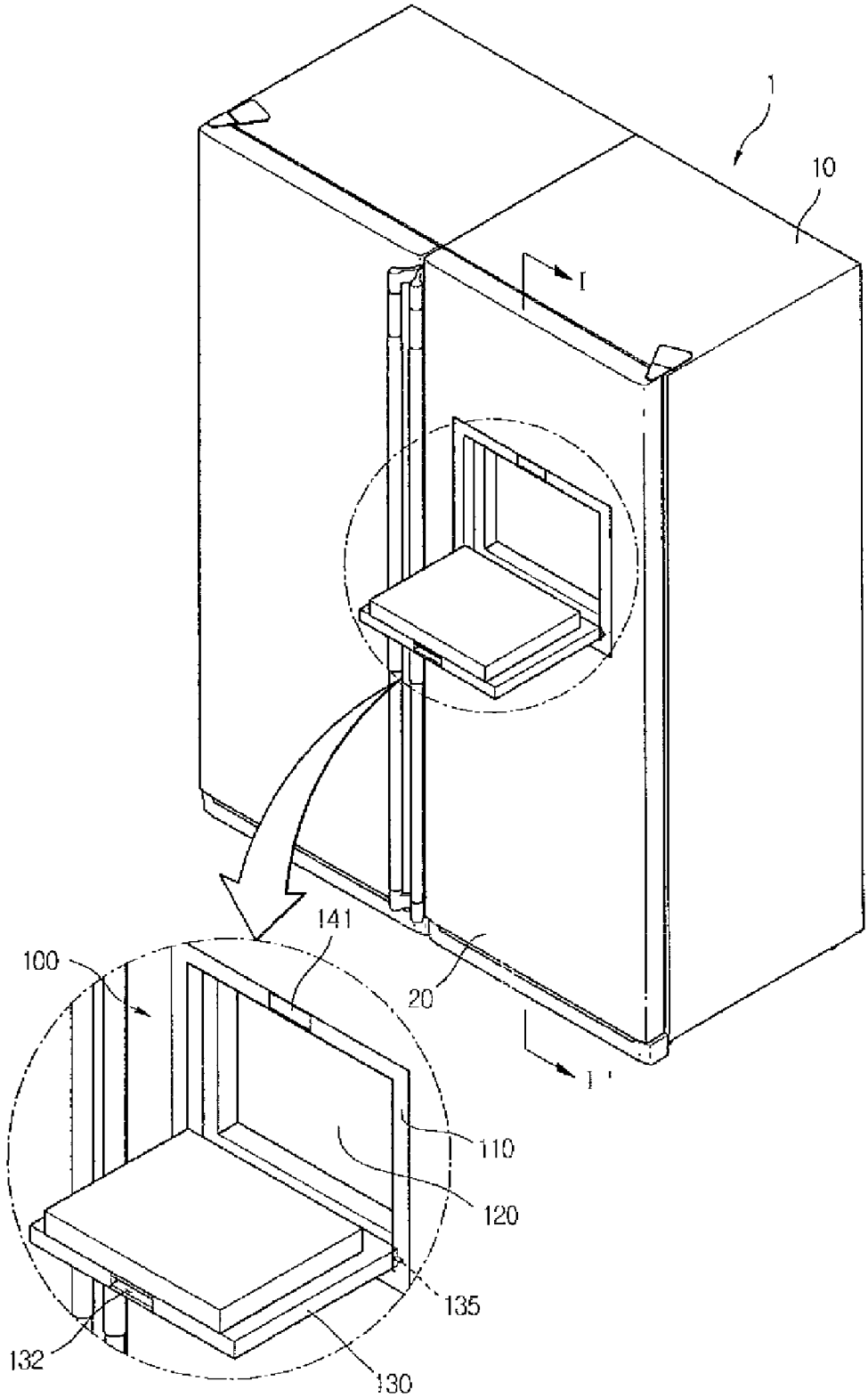
FIG. 1 is a perspective view illustrating a home bar for a refrigerator according to an embodiment.
Figure 2:
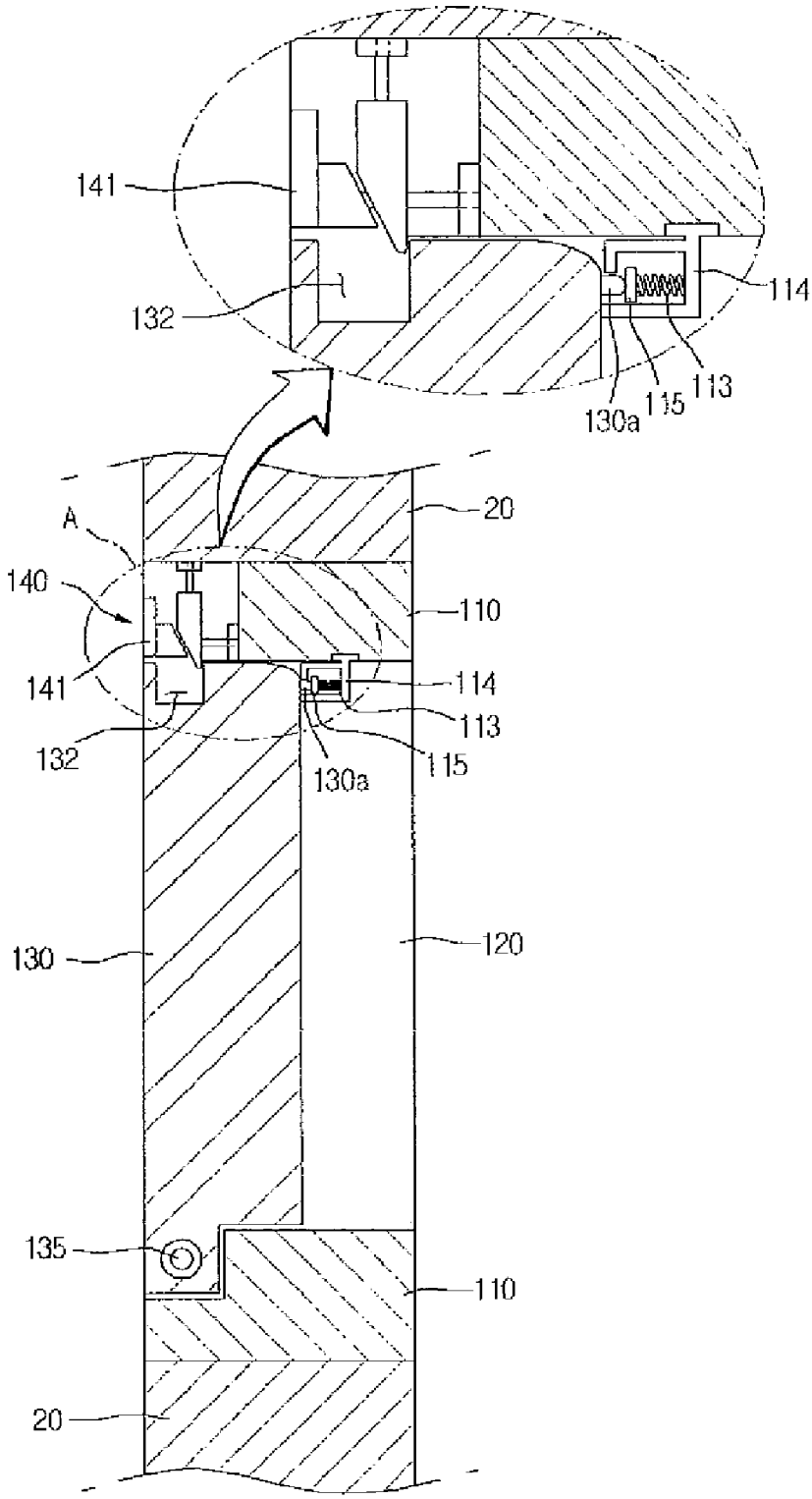
FIG. 2 is a sectional view taken along line I-I' of FIG. 1 according to an embodiment.

FIG. 1 is a perspective view illustrating a home bar for a refrigerator according to an embodiment, and FIG. 2 is a sectional view taken along line I-I' of FIG. 1 according to an embodiment.

Referring to FIGS. 1 and 2, a refrigerator 1 of the current embodiment includes a main body 10 and doors 20. The main body 10 forms the exterior of the refrigerator 1, and the doors

20 are rotatably coupled to the main body 10. The doors 20 may be provided on both sides of the main body 10.

A home bar 3 is provided on a center portion of one of the doors 20 to allow a user to access food or other goods stored in the main body 10.

In detail, the home bar 3 includes a storage space (not shown), an opening 120, a home bar door 130, and a home bar frame 110. The storage space is disposed at a rear side of the door 20 for accommodating goods. The opening 120 is formed through the door 20 to allow access to the storage space. The home bar door 130 is used to selectively close and open the opening 120. The home bar frame 110 makes contact with the home bar door 130 when the home bar door 130 is closed.

The home bar frame 110 is an inner structure of the home bar 3 that forms the opening 120. The home bar frame 110 has different inner widths in a direction from the front side to the inner side of the door 20.

The home bar door 130 has a shape corresponding to the opening 120 so that the opening 120 can be closed using the home bar door 130. The home bar door 130 is rotatable on a hinge part 135 disposed at a lower portion of the opening 120.

That is, the opening 120 can be opened or closed by rotating the home bar door 130 on the hinge part 135. When the home bar door 130 is closed, the front surface of the home bar door 130 is flush with the front surface of the door 20.

A latch groove 132 is formed in a predetermined side of the home bar door 130 as a trapping portion. That is, when the home bar door 130 is closed, a latch member (described later) is trapped in the latch groove 132. The latch groove 132 may be a recess extending downward from an upper end portion of the home bar door 130.

The home bar door 130 has inwardly decreasing widths so that the home bar door 130 can make tight contact with the home bar frame 110 when the home bar door 130 is closed. An insulating material is inserted in the home bar door 130 for preventing leakage of cold air through the home bar door 130.

Unlike home bar doors of the related art, it is unnecessary to install a latch member in the home bar door 130. Therefore, the insulating material can be inserted in the home bar door 130, and thus the insulating ability of the home bar door 130 can be improved.

A button part 141 is disposed at an upper portion of the home bar frame 110. The home bar door 130 can be opened by manipulating the button part 141. When the home bar door 130 is closed, the button part 141 is located at a position corresponding to the latch groove 132.

A user can open the home bar door 130 by pressing the button part 141.

In detail, the button part 141 is a part of a fixing unit 140 that is used to latch the home bar door 130 in a closed position.

The fixing unit 140 is disposed at an upper end portion of the home bar frame 110. When the home bar door 130 is closed, the fixing unit 140 is inserted and held in the latch groove 132 for latching the home bar door 130.

The home bar door 130 can be opened by releasing the fixing unit 140 from the latch groove 132.

A spring 113 is disposed at an inner side of the home bar door 130. When the home bar door 130 is closed, the spring 113 is compressed by the home bar door 130. That is, the spring 113 applies a force to the closed home bar door 130 in a forward direction.

A protrusion 130*a* is disposed on the home bar door 130 for being pushed by the spring 113. The protrusion 130*a* is located at a position corresponding to the spring 113 so as to be pushed by the spring 113 when the home bar door 130 is closed.

The spring 113 is an example of an elastic member that can be used to apply a force to the home bar door 130. Instead of the spring 113, other members can be used to apply a force to the home bar door 130.

A support member 114 is provided on an end of the spring 113 to fix the spring 113 to the home bar frame 110. A pressing part 115 is provided on the other end of the spring 113 for pushing the home bar door 130.

The support member 114 is coupled to an inner side of the home bar frame 110 and extends outward from the home bar frame 110. The spring 113 supported on a bottom surface of the support member 114.

The pressing part 115 may have a plate shape so that an elastic force (a resilient force) can be effectively transmitted from the spring 113 to the protrusion 130*a*. That is, the spring 113 pushes the home bar door 130 through the pressing part 115.

As explained above, since the fixing unit 140 is disposed at the upper end portion of the home bar frame 110, a device such as a latch assembly that is necessary to be installed in the home bar frame 110 in the related art is not required in the current embodiment.

Accordingly, the opening 120 of the home bar frame 110 can be freely used without interference so that food can be easily accessed.

Figure 3:
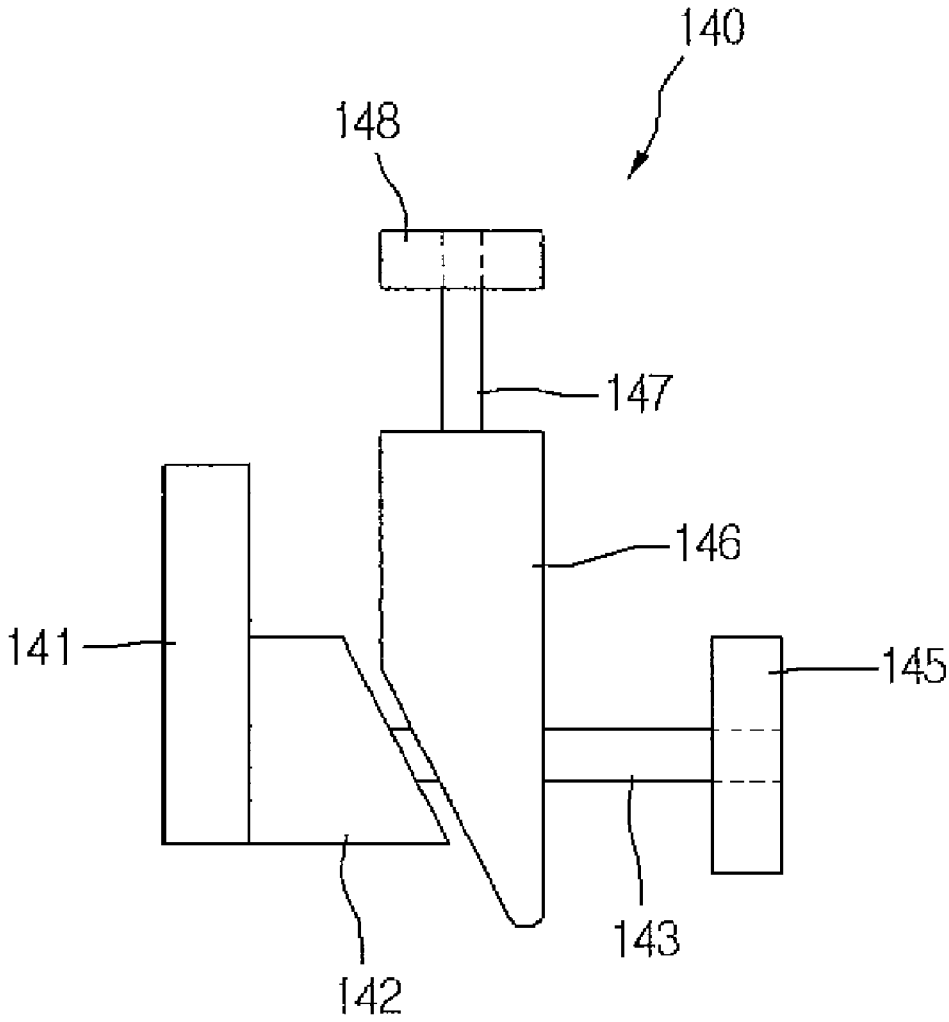
FIG. 3 is a front view illustrating a fixing unit according to an embodiment.
Figure 4:
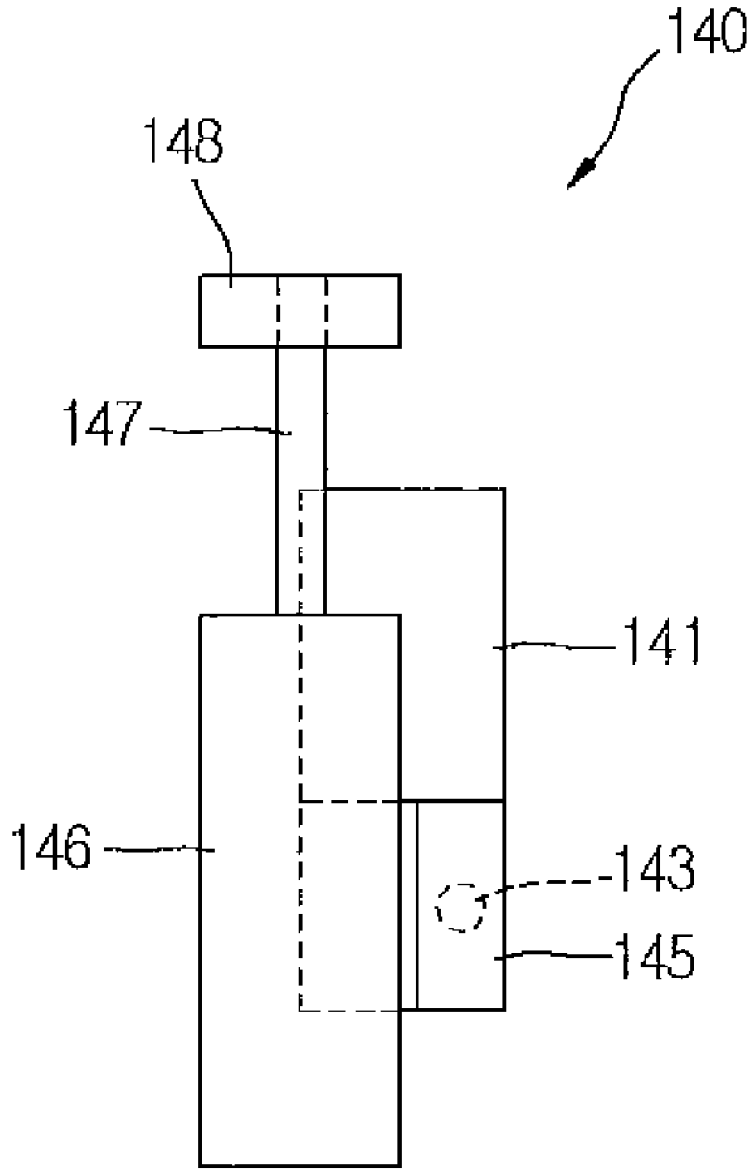
FIG. 4 is a side view illustrating the fixing unit according to an embodiment.
Figure 5:
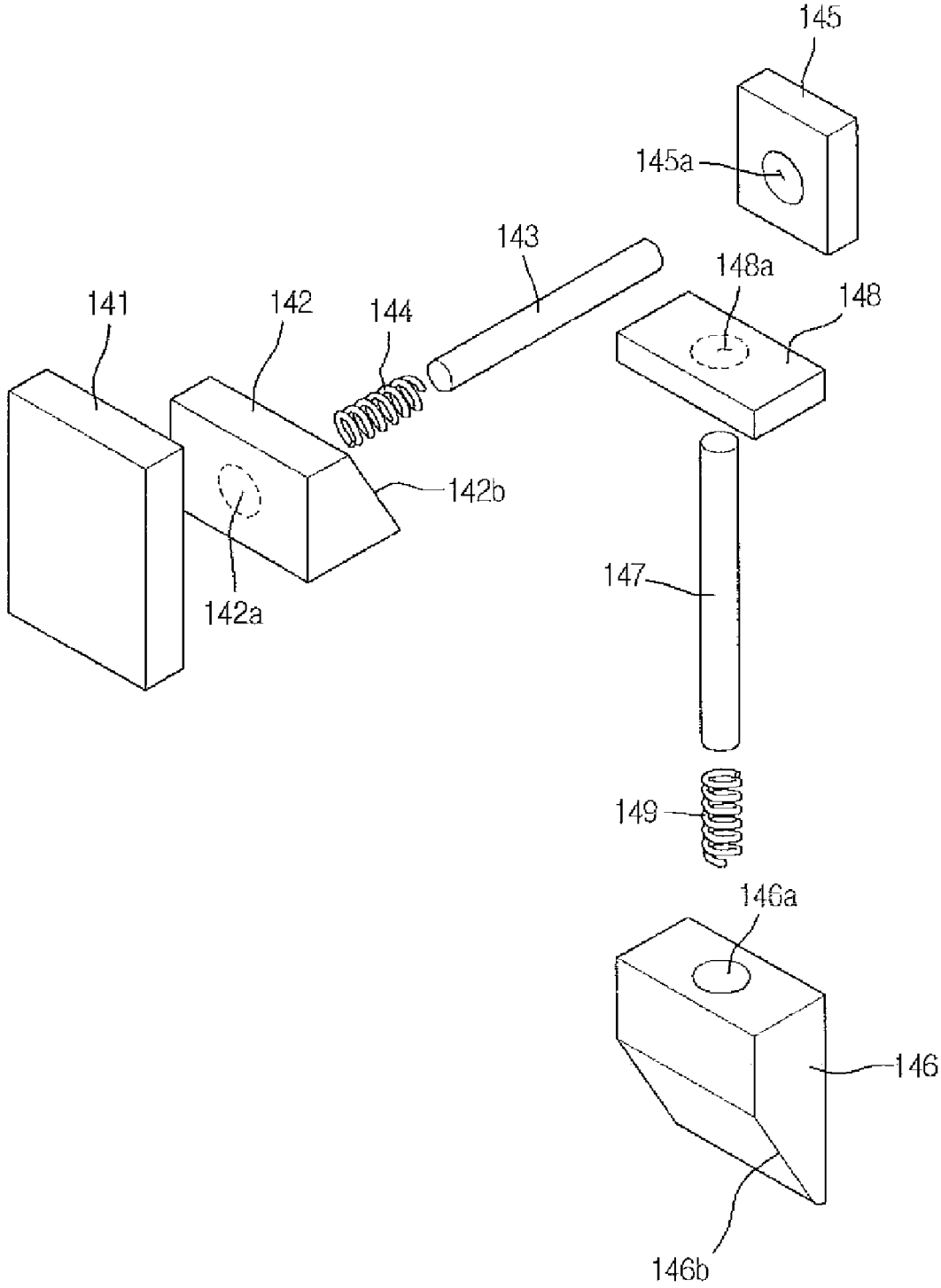
FIG. 5 is an exploded perspective view illustrating the fixing unit according to an embodiment.

FIG. 3 is a front view illustrating the fixing unit 140 according to an embodiment, and FIG. 4 is a side view illustrating the fixing unit 140 according to an embodiment. FIG. 5 is an exploded perspective view illustrating the fixing unit 140 according to an embodiment.

Referring to FIGS. 3 to 5, the fixing unit 140 includes a pressing member 142 and a latch member 146. The pressing member 142 is horizontally movable within the home bar door 130. The latch member 146 is vertically movable within the home bar door 130.

In detail, one side of the pressing member 142 is connected to the button part 141, and the other side of the pressing member 142 is in contact with the latch member 146. The side of the pressing member 142 connected to the button part 141 may be flat and vertical to correspond with the button part 141.

However, the other side of the pressing member 142 may have a first oblique surface 142*b* for interacting with the latch member 146.

An insertion hole 142*a* is formed in the other side of the pressing member 142. A horizontal guide 143 may be inserted in the insertion hole 142*a* for guiding movement of the pressing member 142.

At least a portion of the other side of the pressing member 142 makes into contact with the latch member 146. The insertion hole 142*a* is formed in the other portion of the pressing member 142 that does not make contact with the latch member 146 so that the horizontal guide 143 can be inserted into the insertion hole 142*a*.

In detail, a first spring 144 is disposed in the insertion hole 142*a* for elastic movement of the pressing member 142. The first spring 144 may be disposed between the pressing member 142 and the horizontal guide 143.

One side of the first spring 144 is fixed to the pressing member 142, and the other side of the first spring 144 is connected to the horizontal guide 143.

When the pressing member 142 is pushed backward, the first spring 144 is compressed. The first spring 144 applies a resilient force to the pressing member 142 to move the pressing member 142 forwardly. That is, the first spring 144 may be a compression spring.

A first support part 145 is disposed on an end of the horizontal guide 143 to fix the horizontal guide 143. The first support part 145 is fixed to an inner side of the home bar frame 110. A guide groove 145*a* is formed in the first support part 145 for receiving the horizontal guide 143.

The latch member 146 of the fixing unit 140 moves vertically upon a horizontal movement of the pressing member 142.

A second oblique surface 146*b* is formed on one side of the latch member 146. The second oblique surface 146*b* corresponds to the first oblique surface 142*b* of the pressing member 142. The latch member 146 can be vertically moved while the second oblique surface 146*b* of the latch member 146 makes tight contact with the first oblique surface 142*b* of the pressing member 142.

An insertion hole 146*a* is formed in the latch member 146 for receiving a vertical guide 147. The vertical guide 147 guides movement of the latch member 146.

A second spring 149 is disposed in the insertion hole 146*a* for elastic movement of the latch member 146. The second spring 149 may be disposed between the latch member 146 and the vertical guide 147.

One side of the second spring 149 is fixed to the latch member 146, and the other side of the second spring 149 is connected to the vertical guide 147.

The second spring 149 may be compressed when the latch member 146 moves upward and may return to its original shape when the latch member 146 moves downward. That is, the second spring 149 may be a compression spring.

A second support part 148 is disposed on an end of the vertical guide 147 for supporting and fixing the vertical guide 147. The second support part 148 is fixed to an inner side of the home bar frame 110. A guide groove 148*a* is formed in the second support part 148 for receiving the vertical guide 147.

As explained above, when the pressing member 142 is moved into the home bar door 130, the latch member 146 that is in contact with the pressing member 142 is vertically moved. This operation will be described later in more detail with reference to the accompanying drawings.

Hereinafter, it will be described how the home bar door 130 is released from the fixing unit 140, and how the home bar door 130 is latched by the fixing unit 140 when the home bar door 130 is closed.

Figure 6:
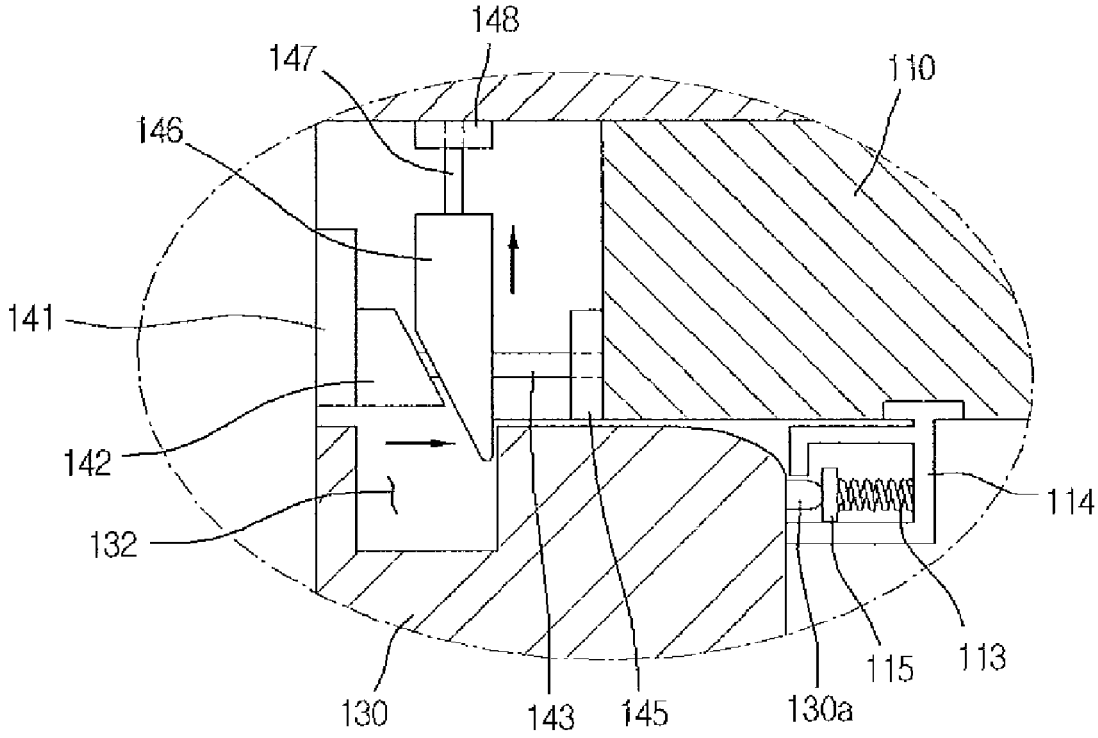
FIG. 6 is a sectional view illustrating how the fixing unit releases a home bar door according to an embodiment.

FIG. 6 is a sectional view illustrating how the fixing unit 140 releases the home bar door 130 according to an embodiment.

Referring to FIG. 6, the fixing unit 140 is fixed to an upper inner side of the home bar frame 110.

In detail, the first support part 145 supporting the pressing member 142, and the second support part 148 supporting the latch member 146 are fixed to the home bar frame 110 such that the fixing unit 140 can be fixed to the home bar frame 110.

When the home bar door 130 is closed, a lower end portion of the latch member 146 is inserted in the latch groove 132. In this way, the fixing unit 140 couples with the home bar door 130 to latch the home bar door 130.

In this state, the home bar door 130 pushes the spring 113, and thus the spring 113 is compressed.

The closed home bar door 130 can be opened by pressing the button part 141 disposed on the front side of the home bar door 130.

When the button part 141 is pressed, the pressing member 142 connected to the button part 141 is moved backward along the horizontal guide 143 that is inserted in the pressing member 142. Accordingly, the latch member 146 disposed on a side of the pressing member 142 is pushed by the pressing member 142. In detail, a pushing force is applied to the latch member 146 in a direction perpendicular to a contact surface between the latch member 146 and the pressing member 142. That is, the pushing force may be applied to the latch member 146 in a right-upward direction.

The latch member 146 can move only in a vertical direction due to the vertical guide 147. That is, the latch member 146 cannot move horizontally. Therefore, the latch member 146 is moved upward along the vertical guide 147 by the pushing force applied from the pressing member 142.

Then, the latch member 146 is released from the latch groove 132, and thus a force holding the home bar door 130 in a closed position disappears.

In this state, the home bar door 130 can be opened by applying a force to the home bar door 130 in a forward direction to rotate down the home bar door 130. This force can be provided by the spring 113.

In detail, when the home bar door 130 is closed, the pressing part 115 is pushed backward by the protrusion 130*a*, and thus the spring 113 connected to the pressing part 115 is compressed by a predetermined length.

In this state, a resilient force is applied to the home bar door 130 from the spring 113 in a forward direction for opening the home bar door 130. However, since the home bar door 130 is latched by the fixing unit 140, the home bar door 130 can be held in the closed position.

That is, the closed home bar door 130 is not opened unless the fixing unit 140 releases the home bar door 130.

When the fixing unit 140 releases the home bar door 130, the home bar door 130 can be opened by a resilient force applied to the home bar door 130 from the spring 113 in a forward direction.

In brief, when the fixing unit 140 is moved to an unlatching position, the home bar door 130 can be opened by a resilient force applied to the home bar door 130 from the 113. In other words, the spring 113 guides opening of the home bar door 130. Thus, the spring 113, the support member 114, and the pressing part 115 can be collectively referred to as an opening guide unit.

If the button part 141 is released after the home bar door 130 is opened, the button part 141 can return to its original position owing to a resilient force of the first spring 144. Then, the latch member 146 is moved downward by a resilient force of the second spring 149 and protrudes from the home bar frame 110 toward the opening 120.

Figure 7:
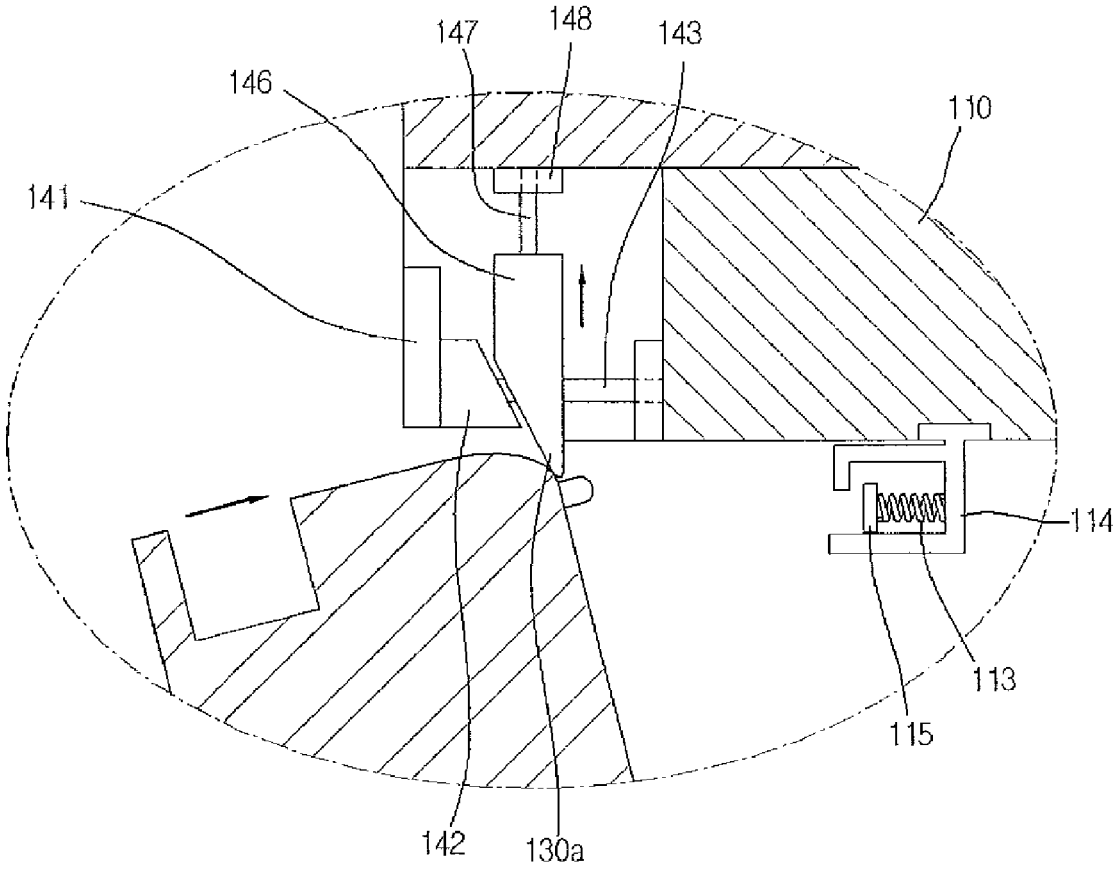
FIG. 7 is a section view illustrating how the fixing unit couples with the home bar door according to an embodiment.

FIG. 7 is a section view illustrating how the fixing unit 130 couples with the home bar door 130 according to an embodiment.

Referring to FIG. 7, a closing operation of the home bar door 130 is illustrated.

As mentioned above, after the home bar door 130 is opened, the lower end portion of the latch member 146 protrudes toward the opening 120. That is, the latch member 146 is in a lower position.

A user can close the opened home bar door 130 by rotating the home bar door 130 upward to the opening 120. As the home bar door 130 is rotated upward, an inner side of the home bar door 130 makes contact with the lower end portion of the latch member 146, and the latch member 146 receives a force from the home bar door 130 in a right-upward direction.

Since the latch member 146 can be moved only in a vertical direction, the latch member 146 is moved upward by the force applied from the home bar door 130. After the latch member 146 is completely moved backward into the home bar frame 110, the home bar door 130 can be further rotated while the home bar door 130 makes contact with the latch member 146.

A soft cover member can be disposed on the latch member 146 to prevent the latch member 146 from scratching the home bar door 130 and allow smooth rotation of the hone bar door 130.

When the home bar door 130 is completely closed, the latch groove 132 is aligned with the latch member 146. Then, the latch member 146 can be moved downward to its original position by a resilient force applied to the latch member 146 from the second spring 149. That is, the latch member 146 is inserted into the latch groove 132 to latch the home bar door 130.

In this state, the protrusion 130*a* of the home bar door 130 is pushed against the pressing part 115, and thus a force is applied to the home bar door 130 from the spring 113 in a forward direction.

As described above, the home bar door 130 can be easily closed and opened. In addition, since the opening/closing mechanism of the home bar door 130 is simple, manufacturing and operating costs can be saved, and an insulating layer of the home bar door 130 can be widen.

According to the above-described embodiments, the home bar door can have a simple structure and be easily opened and closed.

Furthermore, the mechanism for fixing the home bar door can be provided with less costs.

In addition, since a large area is not necessary for installing the fixing unit on the home bar frame, the opening of the home bar frame can be enlarged for providing easy access to foods.

Moreover, since a complicated latch structure of the related art is not used, the insulating area of the home bar can be increased for efficient insulation.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A home bar for a refrigerator, comprising:
- a home bar frame comprising an opening;
- a home bar door configured to close the opening;
- a fixing unit disposed on the home bar frame and configured to latch the home bar door; and
- an elastic member disposed at a side of the fixing unit and configured to apply an elastic force in a predetermined direction for opening the home bar door,
- wherein the fixing unit comprises:
  - a pressing member movable forward and backward;
  - a latch member configured to be moved upward and downward according to backward and forward movements of the pressing member; and
  - guide members configured to guide movements of the pressing member and the latch member, respectively.

2. The home bar according to claim 1, wherein the home bar door comprises a latch groove configured to receive at least a portion of the fixing unit.

3. The home bar according to claim 2, wherein the latch groove extends downward from an upper end portion of the home bar door.

4. The home bar according to claim 1, further comprising a support member configured to support the elastic member with respect to the home bar frame.

5. The home bar according to claim 1, wherein the home bar door comprises a protrusion configured to make contact with the elastic member when the home bar door is closed.

6. A home bar for a refrigerator, comprising:
- a home bar frame comprising an opening;
- a home bar door configured to selectively open and close the opening and comprising a trapping portion;
- a latch member disposed on the home bar frame and configured to be selectively trapped in the trapping portion; and
- a pressing member configured to apply a pushing force to the latch member for opening the home bar door,
- wherein the pressing member and the latch member comprise elastic members, respectively, so as to be elastically moved.

7. The home bar according to claim 6, wherein when the home bar door is opened, the pressing member is moved backward and the latch member is moved upward.

8. The home bar according to claim 7, wherein the pressing member and the latch member further comprise guide members, respectively, so as to be moved under guide of the guide members.

9. The home bar according to claim 6, wherein the latch member comprises at least one oblique side making contact with the pressing member.

10. The home bar according to claim 6, wherein the pressing member comprises at least one oblique side making contact with the latch member.

11. A home bar for a refrigerator, comprising:
- a home bar frame comprising an opening;
- a home bar door configured to selectively open and close the opening and comprising a trapping portion;
- a latch member disposed on the home bar frame and configured to be selectively trapped in the trapping portion;
- a pressing member configured to apply a pushing force to the latch member for opening the home bar door; and
- an opening guide unit disposed close to the home bar door and configured to apply a force in a predetermined direction for opening the home bar door, the opening guide unit comprising an elastic member configured to apply an elastic force to the home bar door,
- wherein the home bar door further comprises a protrusion configured to make contact with the elastic member when the home bar door is closed.

12. The home bar according to claim 11, wherein the opening guide unit comprises an elastic member configured to apply an elastic force to the home bar door.

13. The home bar according to claim 12, wherein the opening guide unit further comprises:
- a pressing part disposed at a side of the elastic member and configured to make contact with the home bar door; and
- a support member configured to support the elastic member with respect to the home bar frame.

14. The home bar according to claim 12, wherein the elastic member is compressed when the home bar door is closed and is restored when the home bar door is opened.

15. The home bar according to claim 11, further comprising a button part connected to the pressing member and configured to be manipulated for opening the home bar door.

* * * * *